US011421569B2

(12) United States Patent
Madi

(10) Patent No.: US 11,421,569 B2
(45) Date of Patent: Aug. 23, 2022

(54) MUFFLER

(71) Applicant: Tenneco Automotive Operating Company Inc., Lake Forest, IL (US)

(72) Inventor: Abdulhadi Madi, East Lansing, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 313 days.

(21) Appl. No.: 16/657,150

(22) Filed: Oct. 18, 2019

(65) Prior Publication Data

US 2021/0115822 A1 Apr. 22, 2021

(51) Int. Cl.
*F01N 1/02* (2006.01)
*F01N 13/20* (2010.01)

(52) U.S. Cl.
CPC ..... *F01N 1/026* (2013.01); *F01N 13/20* (2013.01); *F01N 2210/04* (2013.01); *F01N 2470/02* (2013.01); *F01N 2470/24* (2013.01); *F01N 2490/15* (2013.01)

(58) Field of Classification Search
CPC ..... F01N 1/023; F01N 1/026; F01N 1/083; F01N 2210/04; F01N 2470/24; F01N 2490/15
See application file for complete search history.

(56) References Cited

U.S. PATENT DOCUMENTS 2,115,103 A 4/1938 Haas
2,323,955 A 7/1943 Wilson
3,613,830 A 10/1971 Hubbell
3,682,270 A * 8/1972 Haren ..... F01N 1/084 181/266
4,172,508 A 10/1979 Moss et al.
4,841,728 A * 6/1989 Jean ..... F01N 1/003 181/247
7,537,083 B2 5/2009 Frederiksen
7,575,096 B2 8/2009 Arbuckle et al.
8,607,923 B2 12/2013 Takagaki et al.
(Continued)

FOREIGN PATENT DOCUMENTS

CN 109139190 A * 1/2019
DE 10254631 A1 * 6/2004 ..... F01N 1/023
(Continued)

OTHER PUBLICATIONS

PCT International Search Report and the Written Opinion of the Searching Authority for Counterpart PCT/US2020/054753, dated Dec. 10, 2020, 11 Pages.

*Primary Examiner* — Jonathan R Matthias
(74) *Attorney, Agent, or Firm* — McGarry Bair PC

(57) ABSTRACT

A muffler includes a first tube defining a first inlet for receiving exhaust and a first outlet. The muffler includes a housing defining a tuning chamber. The muffler includes a second tube at least partially received within the first tube. Further, the second tube defines a second inlet disposed within the first tube and a second outlet disposed in fluid communication with the tuning chamber. The muffler further includes a muffler outlet for discharging exhaust from the muffler. Moreover, the first tube and the second tube define an annular passage therebetween. The annular passage is disposed in fluid communication with the first outlet of the first tube and the muffler outlet.

21 Claims, 5 Drawing Sheets

(56) References Cited

U.S. PATENT DOCUMENTS

| | | | | |
|---|---|---|---|---|
| 9,617,882 | B1 | 4/2017 | Hörr | |
| 9,638,077 | B2 | 5/2017 | Hörr | |
| 9,938,870 | B2 | 4/2018 | Reichelt et al. | |
| 2007/0102236 | A1 | 5/2007 | Uhlemann et al. | |
| 2007/0261395 | A1 | 11/2007 | Mahnken et al. | |
| 2017/0074133 | A1* | 3/2017 | Reichelt | F01N 13/04 |
| 2017/0122154 | A1* | 5/2017 | Marquardt-Stammberger | F01N 13/08 |

FOREIGN PATENT DOCUMENTS

| | | | |
|---|---|---|---|
| EP | 2196640 | B1 | 10/2014 |
| EP | 3173595 | B1 | 9/2018 |
| FR | 2713701 | B1 | 3/1996 |
| JP | 2006057553 | A | 3/2006 |
| JP | 2019132266 | A | 8/2019 |
| KR | 20080025995 | A | 3/2008 |
| KR | 20090047083 | A | 5/2009 |
| KR | 20090064184 | A | 6/2009 |
| KR | 20160114761 | A | 10/2016 |

* cited by examiner

MUFFLER

TECHNICAL FIELD

The present disclosure relates to a vehicle exhaust system. More specifically, the present disclosure relates to a muffler of the vehicle exhaust system.

BACKGROUND

A vehicle exhaust system directs exhaust gas generated by an internal combustion engine to an external environment. The exhaust system can include various components, such as pipes, converters, catalysts, filters, and the like. During operation of the exhaust system, as a result of resonating frequencies, the components can generate undesirable noise. Different methods have been employed in various applications to address this issue.

For example, the components, such as tuning chambers, valves, and the like, have been incorporated into the exhaust system to attenuate certain resonance frequencies generated by the exhaust system. However, such additional components are expensive and increase a weight of the exhaust system. Also, adding new components into the exhaust system can introduce new sources of undesirable noise.

A well-known sound attenuation method is use of tuning chambers in mufflers for lowering the exhaust gas noise level. However, such conventional tuning chambers can increase a design complexity and a size of the mufflers. Further, conventional tuning chambers may not effectively attenuate noise of certain frequencies, such as low frequency noise.

Hence, there is a need for an improved muffler for a vehicle exhaust system for such applications.

SUMMARY

In an aspect of the present disclosure, a muffler includes a first tube which defines a first inlet for receiving exhaust and a first outlet. The muffler includes a housing which defines a tuning chamber. The muffler includes a second tube at least partially received within the first tube. Further, the second tube defines a second inlet disposed within the first tube and a second outlet disposed in fluid communication with the tuning chamber. The muffler includes a muffler outlet for discharging exhaust from the muffler. Moreover, the first tube and the second tube define an annular passage therebetween. The annular passage is disposed in fluid communication with the first outlet of the first tube and the muffler outlet.

In another aspect of the present disclosure, a muffler includes a housing and a first partition wall disposed within the housing. The first partition wall and the housing define a first tuning chamber therebetween. The muffler further includes a second partition wall disposed within the housing and spaced apart from the first partition wall. The second partition wall and the housing define a second tuning chamber therebetween. The first partition wall, the second partition wall and the housing define an expansion chamber disposed between the first tuning chamber and the second tuning chamber. The muffler includes a first tube at least partly received within the housing. The first tube defines a first inlet for receiving exhaust and a first outlet disposed in fluid communication with the expansion chamber. The muffler includes a second tube at least partially received within the first tube. The second tube defines a second inlet disposed within the first tube and a second outlet disposed in fluid communication with the first tuning chamber. The muffler further includes a third tube which defines a third inlet in fluid communication with the expansion chamber and a muffler outlet for discharging exhaust from the housing. The first tube and the second tube define an annular passage therebetween. The annular passage is disposed in fluid communication with the first outlet and allows exhaust to flow therethrough.

In yet another aspect of the present disclosure, a muffler includes a housing and a first partition wall disposed within the housing. The first partition wall and the housing define a first tuning chamber therebetween. The muffler further includes a second partition wall disposed within the housing and spaced apart from the first partition wall. The second partition wall and the housing define a second tuning chamber therebetween. The first partition wall, the second partition wall and the housing define an expansion chamber disposed between the first tuning chamber and the second tuning chamber. The muffler further includes a first tube at least partly received within the housing. The first tube defines a first inlet for receiving exhaust and a first outlet disposed in fluid communication with the expansion chamber. The first tube extends through the first partition wall, and a second tube is at least partially received within the first tube. The second tube defines a second inlet disposed within the first tube and a second outlet disposed in fluid communication with the first tuning chamber. The second tube extends through the second partition wall. The muffler further includes a third tube which defines a third inlet in fluid communication with the expansion chamber and a muffler outlet for discharging exhaust from the housing. The third tube extends through the first partition wall, the second partition wall and the housing. The muffler includes a fourth tube fluidly communicating the first tuning chamber with the second tuning chamber. The fourth tube extends through the first partition wall and the second partition wall. The first tube and the second tube define an annular passage therebetween. The annular passage is disposed in fluid communication with the first outlet and allows exhaust to flow therethrough.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION

Figure 1:
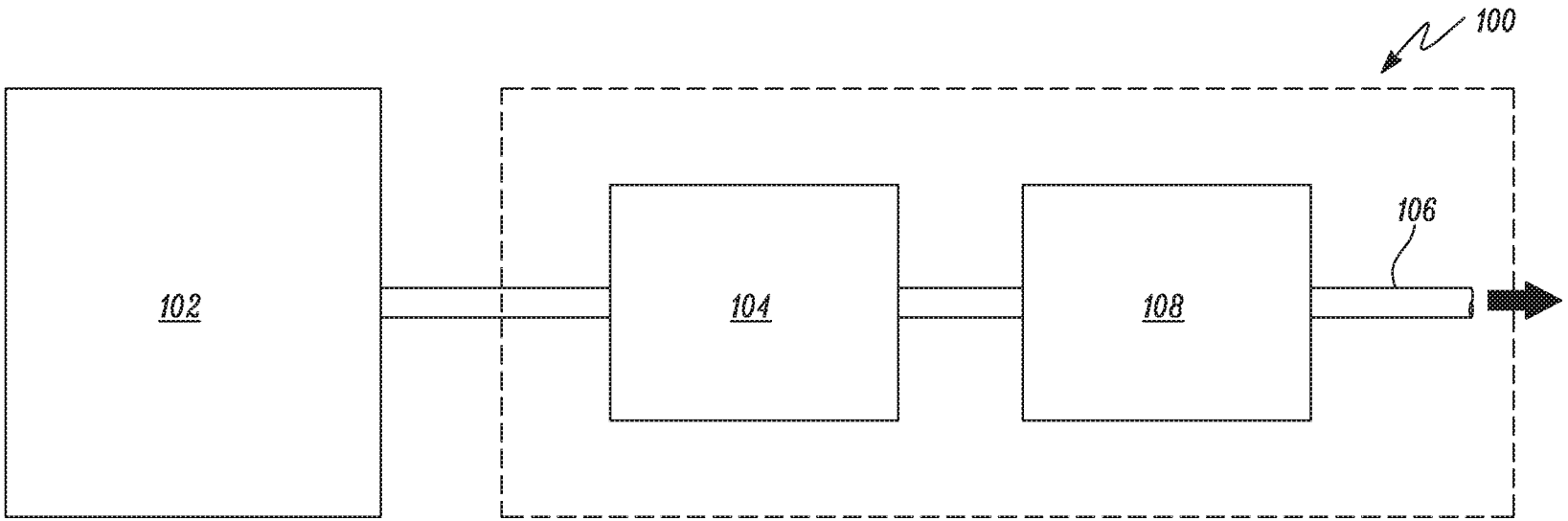
FIG. 1 is a schematic representation of a vehicle exhaust system, according to an aspect of the present disclosure.

The following description of the preferred embodiment(s) is merely exemplary in nature and is in no way intended to limit the invention, its application, or uses. Referring now to the drawings in which like reference numerals designate like or corresponding parts throughout the several views, there as shown in FIG. 1. Referring to FIG. 1, a schematic representation of a vehicle exhaust system 100 is illustrated. The vehicle exhaust system 100 will be hereinafter interchangeably referred to as the "system 100". The system 100 is fluidly coupled to an engine 102. The engine 102 can be any internal combustion engine powered by a fuel, such as diesel, gasoline, natural gas, and/or a combination thereof. Accordingly, the system 100 receives exhaust gas generated by the engine 102.

The system 100 includes a number of downstream exhaust components 104 fluidly coupled to the engine 102. The exhaust components 104 can include a number of systems/components (not shown), such as a Diesel Oxidation Catalyst (DOC), a Diesel Exhaust Fluid (DEF) unit, a Selective Catalytic Reduction (SCR) unit, a particulate filter, an exhaust pipe, an active valve, a passive valve, Exhaust Gas Heat Recovery System (EGHR) and the like. The exhaust components 104 can be mounted in various different configurations and combinations based on application requirements and/or available packaging space. The exhaust components 104 are adapted to receive the exhaust gas from the engine 102 and direct the exhaust gas to the external atmosphere via a tailpipe 106. The exhaust components 104 are adapted to reduce emissions and control noise, and can also be used for thermal management.

In another embodiment, the engine 102 can be part of a hybrid system, i.e., the engine 102 can be operatively coupled with an electric motor and a battery. Further, the exhaust components 104 of the system 100 can be operational only when the engine 102 is burning fuel and not operational when the engine 102 is not running.

The system 100 also includes an acoustic damping member, such as a muffler 108. The muffler 108 is provided in fluid communication with the exhaust components 104 and the tailpipe 106. In the illustrated embodiment, the muffler 108 is disposed downstream of the exhaust components 104 and upstream of the tailpipe 106. In other embodiments, the muffler 108 can be disposed in any sequence with respect to each of the exhaust components 104 and/or the tailpipe 106, based on application requirements. The muffler 108 is adapted to dampen resonance frequencies generated during operation of the engine 102 and the system 100.

Figure 2:
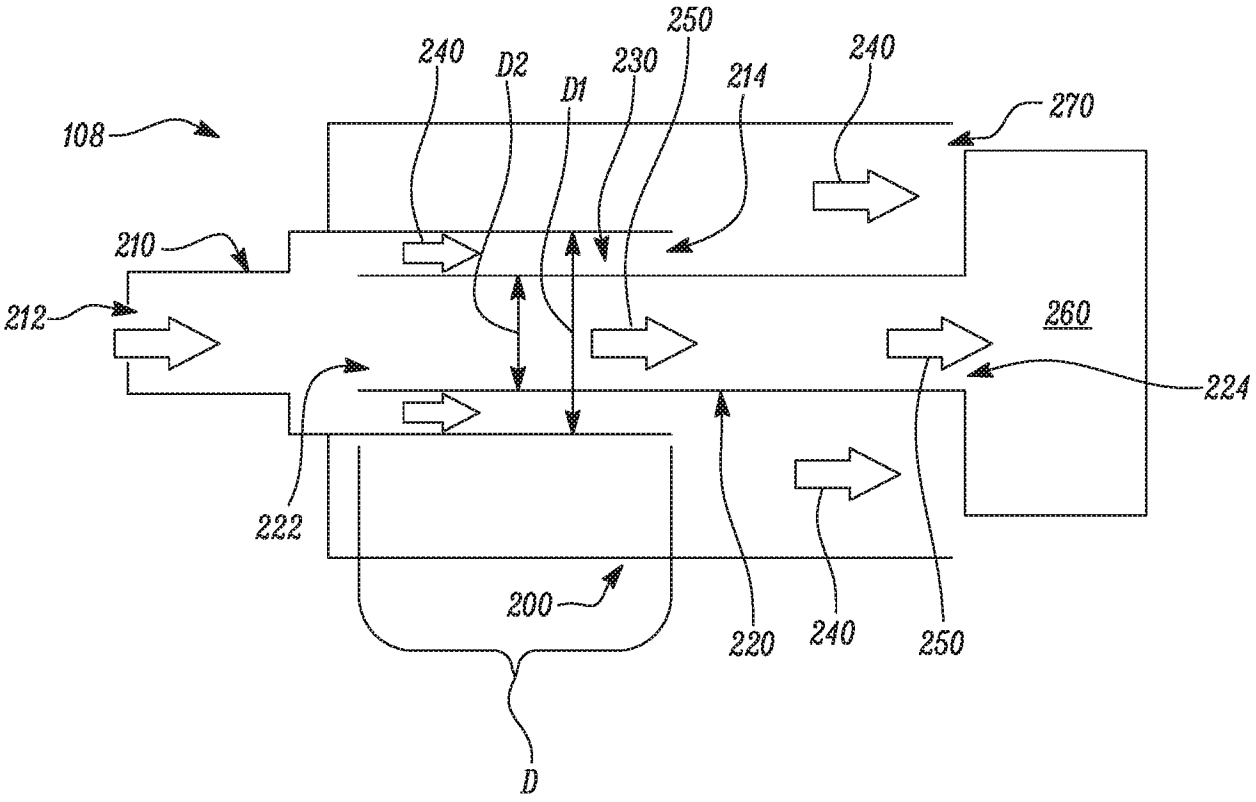
FIG. 2 is a schematic sectional view of a muffler of the vehicle exhaust system of FIG. 1, in accordance with an aspect the present disclosure.
Figure 4:
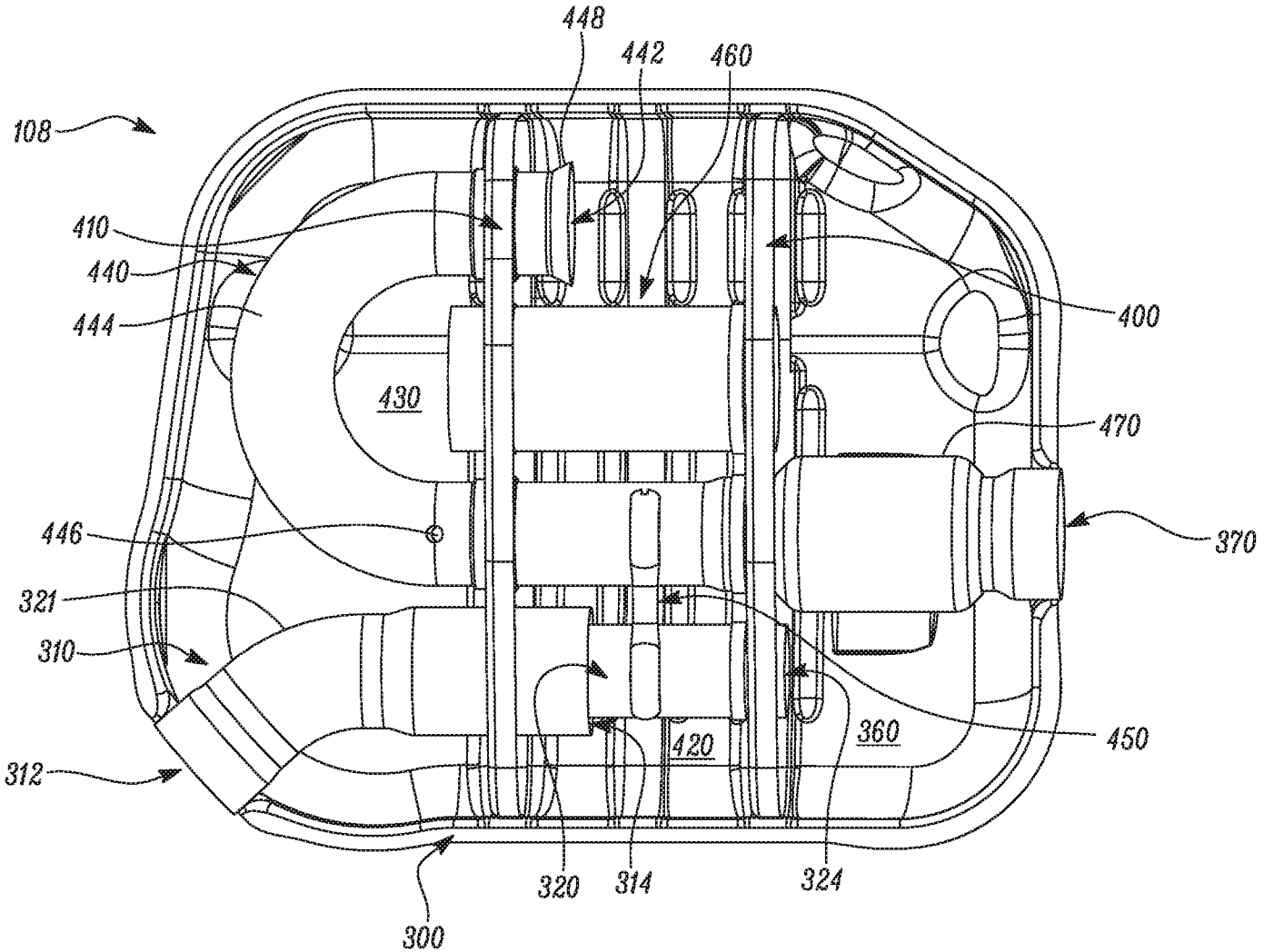
FIG. 4 is a perspective view of an interior of the muffler of FIG. 3, according to an aspect of the present disclosure.

FIG. 2 illustrates a first tube 210 and a second tube 220 of the muffler 108, in accordance with an aspect the present disclosure. The muffler 108 includes the first tube 210 which defines a first inlet 212 for receiving exhaust and a first outlet 214. The first inlet 212 is fluidly coupled to the exhaust components 104 (shown in FIG. 1). The muffler 108 includes a housing 200 which defines a tuning chamber 260 (alternatively, a first tuning chamber 260). In some embodiments, the tuning chamber 260 is a closed chamber. The muffler 108 includes the second tube 220 at least partially received within the first tube 210. The first tube 210 and the second tube 220 overlap each other over an overlapping distance D. Further, the second tube 220 defines a second inlet 222 disposed within the first tube 210 and a second outlet 224 disposed in fluid communication with the tuning chamber 260. The muffler 108 includes a muffler outlet 270 (alternatively, a third outlet 270) for discharging exhaust from the muffler 108. FIG. 2 illustrates merely a schematic representation of the muffler outlet 270, while FIG. 4 represents a preferred representation of the muffler outlet 270. The muffler outlet 270 is fluidly coupled to the tailpipe 106 (shown in FIG. 1) for discharging a flow of the exhaust gases 240. Moreover, the first tube 210 and the second tube 220 define an annular passage 230 therebetween. Further, the annular passage 230 is disposed in fluid communication with the first outlet 214 of the first tube 210 and the muffler outlet 270.

As shown in FIG. 2, the first tube 210 has a diameter D1 and the second tube 220 has a diameter D2. The dimeter D1 of the first tube 210 is greater than the diameter D2 of the second tube 220 such that there is the desired flow of the exhaust gases 240 passing through the annular passage 230 between the first tube 210 and the second tube 220. The difference between the diameters D1, D2 of the first and second tubes 210, 220 can depend upon multiple factors, such as desired backpressure reduction, attenuation level of frequency range, manufacturing feasibility, packaging clearance, durability requirements, modal requirements, or any other factor related to the system 100 (shown in FIG. 1). Backpressure can be a function of a mass flow rate of exhaust gases 240 passing through the muffler 108. In various cases, the mass flow rate can be 100% of engine flow or a percentage of engine flow, such as 50%. In some embodiments, the dimeter D1 of the first tube 210 can be around 55 mm. Further, the diameter D2 of the second tube 220 can be around 45 mm. Further, a thickness and a length of the second tube 220 can be around 1.2 mm and 145 mm respectively.

The first tube 210 and the second tube 220 are generally illustrated as cylindrical straight tubes, however some embodiments can have the first tube 210 and the second tube 220 with any other shape or arrangement. More particularly, the first tube 210 and the second tube 220 can have any non-linear shape, such as curved, combination of linear and curved portions, and the like. Further, there can be one or more dents (not shown) disposed between the first tube 210 and the second tube 220 such that the first tube 210 and the second tube 220 are in contact due to the dents. This may ensure proper alignment and prevent any inadvertent movement of the second tube 220 within the first tube 210, particularly during working of the muffler 108. In the illustrated embodiment, the second tube 220 is concentrically disposed within the first tube 210. However, in some other embodiments, the second tube 220 can be eccentrically disposed within the first tube 210.

As illustrated, the exhaust gases 240 pass through the annular passage 230 between the first tube 210 and the second tube 220, while there is a propagation of sound waves 250 through the second tube 220 for desired attenuation in the tuning chamber 260. Depending on the design, there may be a small portion of the exhaust gases 240 which passes through the second tube 220, while allowing the sound waves 250 to propagate through the second tube 220. This flow of the exhaust gases 240 can be a result of leakage from the tuning chamber 260. Leakage from the tuning chamber 260 may occur due to condensate holes/channel or due to holes in a partition. The exhaust gases 240 passing through the second tube 220 can be a fraction (less than 50%) of the total flow of the exhaust gases 240. This leads to a "Helmholtz effect" as will be evident to a person having ordinary skill in the art. As used herein, "Helmholtz effect" as used in the present disclosure is produced by a combination of a tuner and/or an enclosed volume/chamber to attune sound waves 250 within the muffler 108. The present disclosure includes two pipes (i.e., the first tube 210 and the second tube 220) concentrically arranged having the annular passage 230 therebetween to allow the flow of the exhaust gases 240 while the sound waves 250 are attuned by the combination of the tuner (i.e. the second tube 220) and the enclosed volume/chamber (i.e., the tuning chamber 260).

In some embodiments, the first tube 210 and the second tube 220 can have dimples (not shown) around the overlapping distance D. The dimples can have a diameter which depends on performance requirements, while the number of the dimples around the overlapping distance D can be any suitable number. Further, the overlapping distance D between the first tube 210 and the second tube 220 can be around 50 mm. Moreover, the first tube 210 and the second tube 220 can be mechanically joined to each other by one or more of welding, fasteners, and gluing. Further, the length of the second tube 220 can be increased to tune lower frequency sounds, such as the length of the second tube 220 can be increased by 80 mm or by any other measure as per the requirement.

Figure 3:
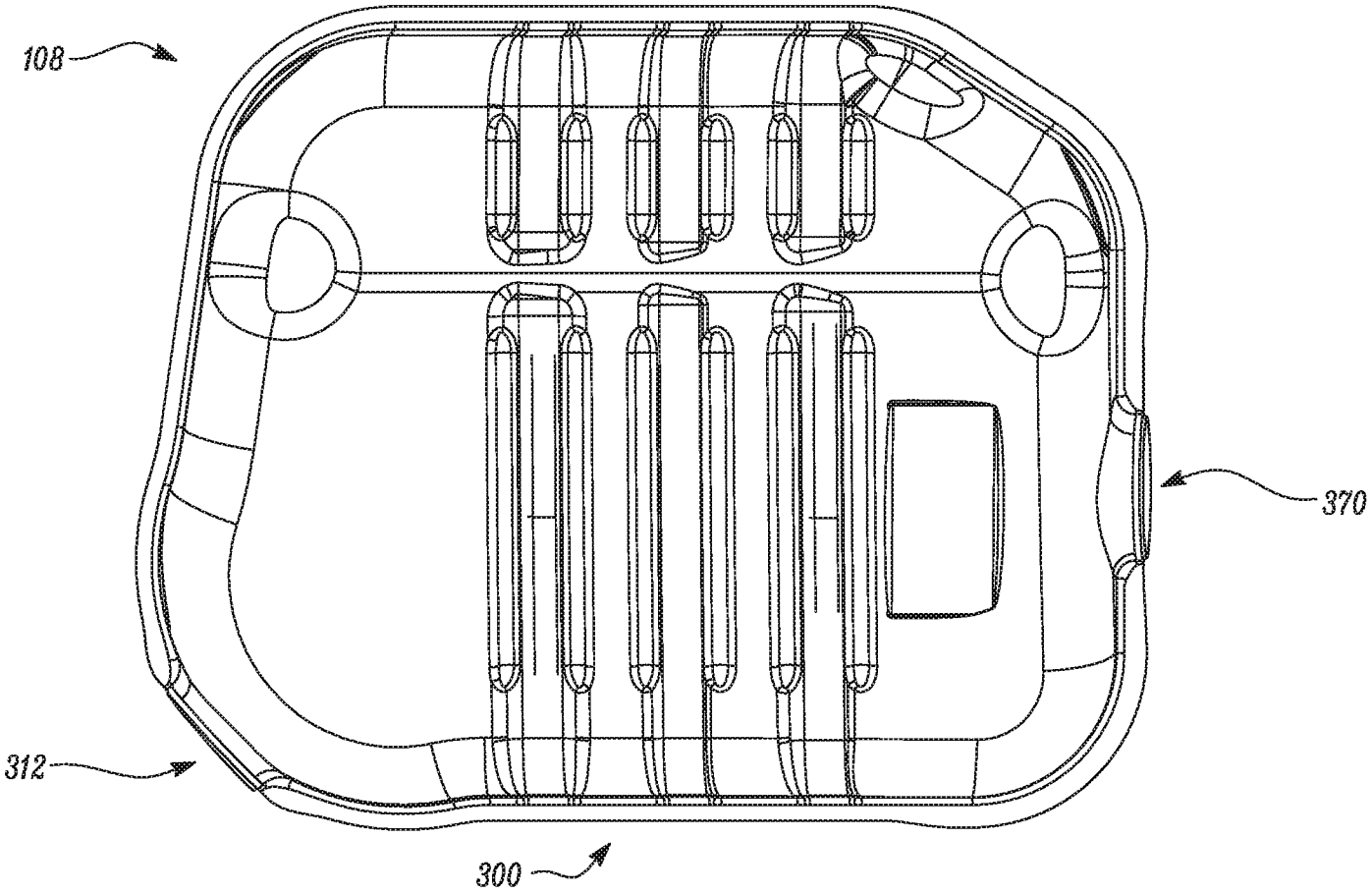
FIG. 3 is a perspective view of a muffler of the vehicle exhaust system of FIG. 1, according to another aspect of the present disclosure.

FIG. 3 illustrates another embodiment of the muffler 108. As illustrated in FIG. 3, the muffler 108 includes a housing 300. The muffler 108 includes a first partition wall 400 disposed within the housing 300. The first partition wall 400 and the housing 300 define a first tuning chamber 360 therebetween. The muffler 108 includes a second partition wall 410 disposed within the housing 300 and spaced apart from the first partition wall 400. The second partition wall 410 and the housing 300 define a second tuning chamber 430 (alternatively, another tuning chamber 430) therebetween. The first partition wall 400, the second partition wall 410 and the housing 300 define an expansion chamber 420 disposed between the first tuning chamber 360 and the second tuning chamber 430.

Figure 5:
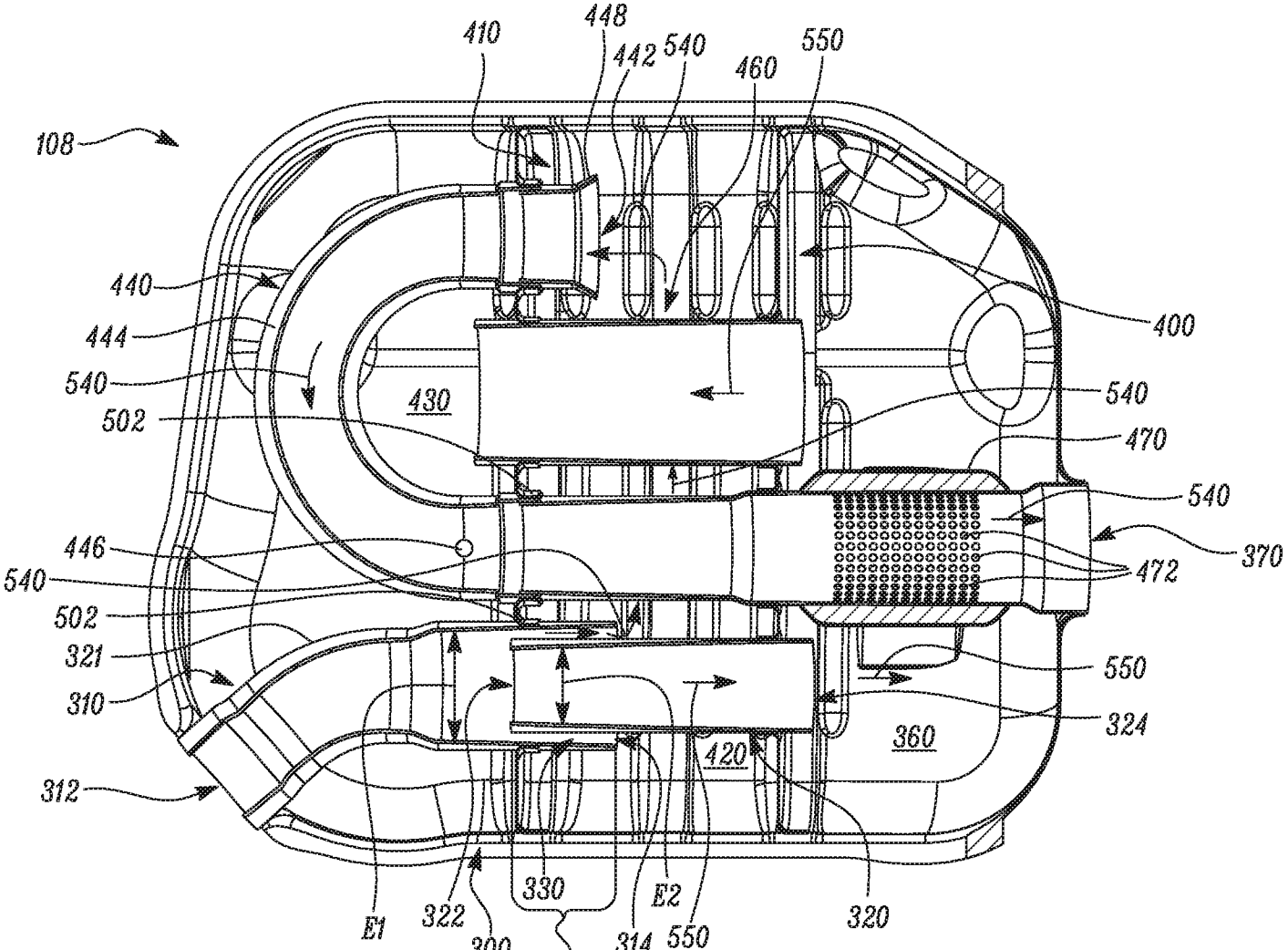
FIG. 5 is a cross-sectional view of the muffler of FIG. 4, according to an aspect of the present disclosure.

The housing 300 can have a two-part arrangement, were one part of the two-part of the housing 300 can be removed to have access inside the housing 300, as shown in FIG. 4. FIG. 5 illustrates a sectional view of the muffler 108 shown in FIG. 4. Referring to FIGS. 3, 4 and 5, the housing 300 has a first inlet 312 to receive exhaust from the engine 102 (shown in FIG. 1), and a third outlet 370 for discharging the exhaust from the housing 300. The third outlet 370 is interchangeably referred to as "the muffler outlet 370". As illustrated in FIG. 4, the housing 300 defines the expansion chamber 420 and the first tuning chamber 360 different from the expansion chamber 420. The first tuning chamber 360 is interchangeably referred to as "the tuning chamber 360". The muffler 108 includes a first tube 310 at least partly received within the housing 300, particularly within the second tuning chamber 430. The first tube 310 defines the first inlet 312 and a first outlet 314. The first tube 310 defines the first inlet 312 for receiving exhaust and the first outlet 314 disposed in fluid communication with the expansion chamber 420. The first tube 310 extends through the first partition wall 400. The muffler 108 includes a second tube 320 at least partially received within the first tube 310.

The second tube 320 includes a curved portion 321 adjacent to the first inlet 312. The muffler 108 further includes a second tube 320. The second tube 320 defines a second inlet 322 and a second outlet 324. The second inlet 322 is disposed within the first tube 310. The second outlet 324 is disposed in fluid communication with the first tuning chamber 360. The second tube 320 extends through the second partition wall 410. In the illustrated embodiment, the first tube 310 and the second tube 320 are concentrically disposed relative to each other. The muffler 108 further includes the first partition wall 400 disposed within the housing 300. The first partition wall 400 separates the tuning chamber 360 from the expansion chamber 420. Further, the first outlet 314 of the first tube 310 is in fluid communication with the expansion chamber 420, and the expansion chamber 420 is in fluid communication with the muffler outlet 370. The muffler 108 further includes a second partition wall 410 disposed within the housing 300. The second partition wall 410 separates the expansion chamber 420 from the other tuning chamber 430 such that the expansion chamber 420 is disposed between the tuning chamber 360 and the other tuning chamber 430. Moreover, the first tube 310 extends through the second partition wall 410. The present disclosure illustrates the first partition wall 400 and the second partition wall 410 which divide the housing 300 into the first tuning chamber 360, the expansion chamber 420 and the second tuning chamber 430, however the present disclosure can be implemented with any other arrangement or number of the partition walls and/or the chambers.

The first tube 310 and the second tube 320 define an annular passage 330 therebetween. The annular passage 330 is disposed in fluid communication with the first outlet 314 and allows exhaust to flow therethrough.

The present disclosure illustrates the second tube 320 extending into the tuning chamber 360. However, in other embodiments, the second tube 320 can be substantially flush with the first partition wall 400. Various arrangements of the second tube 320 can be dependent upon acoustic requirements, expected exhaust flow through the first tube 310 and the second tube 320, or any other factor associated with the muffler 108.

The muffler 108 further includes a third tube 440 defining a third inlet 442 in fluid communication with the expansion chamber 420 and the muffler outlet 370. The third tube 440 extends through the first partition wall 400, the second partition wall 410 and the housing 300. Moreover, the muffler outlet 370 is disposed adjacent to the housing 300. As illustrated, a fourth tube 460 fluidly communicates the first tuning chamber 360 with the second tuning chamber 430. The fourth tube 460 extends through the first partition wall 400 and the second partition wall 410. In some embodiments, a length of the first tuning chamber 360 can be around 149 mm, while lengths of the expansion chamber 420 and the second tuning chamber 430 can be around 136 mm and 144.7 mm, respectively. A volume of the fourth tube 460 can impact the tuning frequencies of the first tuning chamber 360 and the second tuning chamber 430. For example, if the volume of the fourth tube 460 is small as compared to tuning chamber volume, the fourth tube 460 can reduce the tuning frequency of the first tuning chamber 360 and increase the tuning frequency of the second tuning chamber 430. However, if the volume of the fourth tube 460 is large (e.g., greater than 50% of tuning chamber volume), the first and second tuning chambers 360, 430 may effectively act as a single tuning chamber with an effective tuning frequency lesser than the individual tuning frequencies of the first and second tuning chambers 360, 430.

During operation, a flow of exhaust gases 540 occurs through the first inlet 312 of the housing 300 and passes through the first tube 310 before moving through the annular passage 330 between the first tube 310 and the second tube 320. A propagation of sound waves 550 through the second tube 320 and then through the expansion chamber 420 mat lead to attenuation of sound. The exhaust gases 540 then travel inside the expansion chamber 420 before entering into the third tube 440 through the third inlet 442. The third tube 440 transports the exhaust gases 540 to the third outlet 370 to discharge the exhaust gases 540 from the housing 300. In some cases, some of the exhaust gases 540 can enter the first tuning chamber 360, from where the exhaust gases 540 can move to the second tuning chamber 430 through the fourth tube 460. More particularly, the fourth tube 460 can allow flow of any exhaust gases 540 from the first tuning chamber 360 to the second tuning chamber 430. Then, the exhaust gases 540 in the second tuning chamber 430 can enter the third tube 440 through one or more openings 446 of the third tube 440. Preferably, there are two openings 446 provided on diametrically opposite ends of the third tube 440. The number of the openings 446 can be varied based on factors such as exhaust flow volume, sound attenuation requirements. The exhaust gases 540 then move inside the third tube 440 to move out of the housing 300 through the third outlet 370, as mentioned earlier. In some embodiments, the third tube 440 can have one or more openings 446 as per the requirement of the engine 102 or the muffler 108. The openings 446 can be provided in order to take out the small amounts of exhaust gases 540 which can be present in the second tuning chamber 430. The openings 446 can allow the exhaust gases 540 within the second tuning chamber 430 to enter the third tube 440 through the openings 446 and leave through the third outlet 370.

In some embodiments, the size of the openings 446 can be around 8 mm. The openings 446 can provide benefits such as to prevent or mitigate some standing waves inside the third tube 440, or any other benefit as will be evident to a person having ordinary skill in the art.

The fourth tube 460 can also transport the sound waves 550 from the first tuning chamber 360 to the second tuning chamber 430. The sound waves 550 can then be attenuated through reflection. In some embodiments, combination of the tuning chamber 360 and the other tuning chamber 430 increases the tuning efficiency of the muffler 108 and provides flexibility to optimize and balance acoustics performance for a given frequency range. Lengths and diameters of the second and fourth tubes 220, 460 may be optimized to meet an acoustics performance target of the muffler 108. If the acoustic performance target changes, these parameters (i.e., lengths and diameters) may change accordingly. Moreover, combining the tuning chamber 360 and the other tuning chamber 430 allows to have desired (e.g., long) length of the tail pipe 106 (shown in FIG. 1) which works better for low frequency as well. From manufacturing considerations, having the interference and the annular passage 330 between the first tube 310 and the second tube 320 helps to avoid some manufacturing and fabrication limitations, such as perforations on the curved portion 321.

In an embodiment, the third tube 440 further includes a flared portion 448 at least partially disposed within the expansion chamber 420. The flared portion 448 defines the third inlet 442. Further, the flared portion 448 allows the flow of the exhaust gases 540 to enter the third tube 440 through the third inlet 442. The flared portion 448 can be funnel-shaped to allow ease of intake or suction of the flow of the exhaust gases 540 through the third inlet 442 during operation of the muffler 108. Additionally, or alternatively, there can be one or more perforations (not shown) around the flared portion 448 of the third tube 440 to ease the flow of the exhaust gases 540 entering the third tube 440 within the expansion chamber 420. This may help in maintaining lower Mach number or flow velocity at the entrance of the third tube 440, or even beyond the entrance point upto a certain length. This generally helps in avoiding potential flow noise and increased backpressure.

The muffler 108 includes a retaining member 450 joined to the second tube 320 and the third tube 440. The presence of the retaining member 450 can serve to secure the second tube 320 in place, particularly retaining and shielding the second tube 320 from any vibration or inadvertent force during working of the muffler 108. In some embodiments, the retaining member 450 can be a support sheet or metal bracket which can be welded to the second tube 320 and the third tube 440 as per the application.

Further, a connecting member (not shown) can join the first tube 310 and the second tube 320. The connection member can include one or more rods which connect the first tube 310 and the second tube 320. When two or more rods are used as the connecting member, the rods can be spaced apart. Alternatively, a single rod can be used as the connecting member where the single rod is welded around its edges to the first tube 310 and the second tube 320.

FIG. 5 is a cross-sectional view of the muffler 108 of FIG. 4, according to an aspect of the present disclosure. As illustrated, the third tube 440 further includes a curved portion 444 at least partially disposed within the second tuning chamber 430. The curved portion 444 defines the one or more openings 446. The opening 446 can be located around 15 mm away from an end of the curved portion 444 of the third tube 440. The first tube 310 and the second tube 320 overlap each other over an overlapping distance E. As shown in FIG. 5, the first tube 310 has a diameter E1 and the second tube 320 has a diameter E2. The dimeter E1 of the first tube 310 is greater than the diameter E2 of the second tube 320 such that there is the desired flow of the exhaust gases 540 passing through the annular passage 330 between the first tube 310 and the second tube 320.

Further, the third tube 440 can have a section in the first tuning chamber 360 having a pinch can 470 with roving. The pinch can 470 can be generally cylindrical-shaped and define a plurality of perforations 472 which can be filled with roving (i.e., any sound absorbing material, such as fiberglass insulation). The presence of the pinch can 470 with roving can enable high frequency noise attenuation along with other benefits. In some embodiments, the pinch can 470 can have a length of about 150 mm, although any other length of the pinch can 470 be implemented in the present disclosure.

As illustrated in FIG. 5, the first tube 310, the third tube 440, and the fourth tube 460 are provided with brackets 502 between them to provide support and check any inadvertent movement due to vibrations during working of the muffler 108. More particularly, the first tube 310, and the third tube 440 can be provided with the brackets 502 while the third tube 440 can, in turn, have the brackets 502 supporting it with the fourth tube 460. The brackets 502 can be further supported or supplemented with welding, riveting or any other coupling means as used or known in the art. The number, position, type, and arrangement of the brackets 502 can be in accordance with factors such as vibrational dynamics of the first tube 310, the third tube 440, and the fourth tube 460, or the mufflers itself.

The arrangement of the present disclosure with the second tube 320 at least partially received within the first tube 310 provides a simple, compact and efficient design of the muffler 108. This can be appreciated by the overlapping distance E between the first tube 310 and the second tube 320 which saves substantial space within the tuning chamber 360, by reducing the dimensional footprint of the second tube 320 within the required limit. The present disclosure provides desired sound attenuation by combined tuning of the tuning chamber 360 and the other tuning chamber 430 which works more efficiently than tuning provided by conventional mufflers designs.

While aspects of the present disclosure have been particularly shown and described with reference to the embodiments above, it will be understood by those skilled in the art that various additional embodiments can be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A muffler comprising:

a first tube defining a first inlet for receiving exhaust and a first outlet; the first tube having an expanded area such that the first outlet has a greater area than the first inlet;

a housing defining a tuning chamber;

a second tube at least partially received within the expanded area of the first tube, the second tube defining a second inlet disposed within the first tube and a primary exhaust path through the second tube, the second tube comprising a second outlet disposed in the tuning chamber; and a muffler outlet for discharging exhaust from the muffler;

wherein the first tube and the second tube define an annular passage therebetween and a secondary exhaust path, the annular passage defines the first outlet of the first tube and is in fluid communication with the muffler outlet; and wherein the primary exhaust path is into the tuning chamber and the secondary exhaust path is through the first outlet and the muffler outlet.

2. The muffler of claim 1, wherein the first tube and the second tube are concentrically disposed relative to each other.

3. The muffler of claim 1, further comprising a first partition wall disposed within the housing and separating the tuning chamber from an expansion chamber, wherein the first outlet of the first tube is in fluid communication with the expansion chamber, and wherein the expansion chamber is in fluid communication with the muffler outlet.

4. The muffler of claim 3, further comprising a second partition wall disposed within the housing, the second partition wall separating the expansion chamber from another tuning chamber such that the expansion chamber is disposed between the tuning chamber and the other tuning chamber, wherein the first tube extends through the second partition wall.

5. The muffler of claim 4, further comprising a third tube defining a third inlet in fluid communication with the expansion chamber and the muffler outlet.

6. The muffler of claim 5, wherein the third tube extends through the first partition wall, the second partition wall and the housing, wherein the muffler outlet is disposed adjacent to the housing.

7. The muffler of claim 5, wherein the third tube further comprises a curved portion at least partially disposed within the other tuning chamber, the curved portion defining one or more openings therethrough.

8. The muffler of claim 5, wherein the third tube further comprises a flared portion at least partially disposed within the expansion chamber, the flared portion defining the third inlet.

9. The muffler of claim 5, further comprising a retaining member joined to the second tube and the third tube.

10. The muffler of claim 4, further comprising a fourth tube fluidly communicating the tuning chamber with the other tuning chamber, the fourth tube extending through the first partition wall and the second partition wall.

11. The muffler of claim 1, wherein the tuning chamber is a closed chamber.

12. A muffler comprising:

a housing;

a first partition wall disposed within the housing, the first partition wall and the housing defining a first tuning chamber therebetween;

a second partition wall disposed within the housing and spaced apart from the first partition wall, the second partition wall and the housing defining a second tuning chamber therebetween, and wherein the first partition wall, the second partition wall and the housing define an expansion chamber disposed between the first tuning chamber and the second tuning chamber;

a first tube at least partly received within the housing, the first tube defining a first inlet for receiving exhaust and a first outlet disposed in fluid communication with the expansion chamber; the first tube having an expanded area such that the first outlet has a greater area than the first inlet;

a second tube at least partially received within the expanded area of the first tube, the second tube defining a second inlet disposed within the first tube and a primary exhaust path through the second tube, the second tube comprising a second outlet disposed in the first tuning chamber; and a third tube defining a third inlet in the expansion chamber and a having a muffler outlet for discharging exhaust from the housing;

wherein the first tube and the second tube define an annular passage therebetween and a secondary exhaust path, the annular passage the first outlet of the first tube and is in fluid communication with the third inlet; and wherein the primary exhaust path is into the first tuning chamber and the secondary exhaust path is through the third inlet and the muffler outlet.

13. The muffler of claim 12, wherein the first tube and the second tube are concentrically disposed relative to each other.

14. The muffler of claim 12, wherein the third tube further comprises a curved portion at least partially disposed within the second tuning chamber, the curved portion defining one or more openings therethrough.

15. The muffler of claim 12, wherein the third tube further comprises a flared portion at least partially disposed within the expansion chamber, the flared portion defining the third inlet.

16. The muffler of claim 12, wherein the third tube extends through the first partition wall, the second partition wall and the housing, wherein the muffler outlet is disposed adjacent to the housing.

17. The muffler of claim 12, further comprising a fourth tube fluidly communicating the first tuning chamber with the second tuning chamber, the fourth tube extending through the first partition wall and the second partition wall.

18. The muffler of claim 12, further comprising a retaining member joined to the second tube and the third tube.

19. A muffler comprising:

a housing;

a first partition wall disposed within the housing, the first partition wall and the housing defining a first tuning chamber therebetween;

a second partition wall disposed within the housing and spaced apart from the first partition wall, the second partition wall and the housing defining a second tuning chamber therebetween, and wherein the first partition wall, the second partition wall and the housing define an expansion chamber disposed between the first tuning chamber and the second tuning chamber;

a first tube at least partly received within the housing, the first tube defining a first inlet for receiving exhaust and a first outlet disposed in fluid communication with the expansion chamber, wherein the first tube extends through the first partition wall;

a second tube at least partially received within the first tube, the second tube defining a second inlet disposed within the first tube and a second outlet disposed in fluid communication with the first tuning chamber, wherein the second tube extends through the second partition wall; and a third tube defining a third inlet in fluid communication with the expansion chamber and a muffler outlet for discharging exhaust from the housing, wherein the third tube extends through the first partition wall, second partition wall and the housing;

a fourth tube fluidly communicating the first tuning chamber with the second tuning chamber, the fourth tube extending through the first partition wall and the second partition wall;

wherein the first tube and the second tube define an annular passage therebetween, and wherein the annular passage is disposed in fluid communication with the first outlet and allows exhaust to flow therethrough.

20. The muffler of claim 19, wherein the third tube further comprises a curved portion at least partially disposed within the other tuning chamber, the curved portion defining one or more openings therethrough.

21. The muffler of claim 19, further comprising a retaining member joined to the second tube and the third tube.

* * * * *